United States Patent [19]

Rosen

[11] Patent Number: 4,967,492

[45] Date of Patent: Nov. 6, 1990

[54] ADJUSTABLE GIRTH SHOES

[76] Inventor: Henri E. Rosen, 229 Coolidge Ave., Watertown, Mass. 02172

[21] Appl. No.: 226,402

[22] Filed: Jul. 29, 1988

[51] Int. Cl.[5] ..... A43B 3/26

[52] U.S. Cl. ..... 36/97

[58] Field of Search ..... 36/8.4, 88, 97

[56] References Cited

U.S. PATENT DOCUMENTS

| | | | |
|---|---|---|---|
| 831,210 | 9/1906 | Bosley | 36/97 |
| 2,978,817 | 4/1961 | Brenner | 36/97 |
| 3,686,777 | 8/1972 | Rosen | 36/97 |

*Primary Examiner*—Werner H. Schroeder
*Assistant Examiner*—D. Biefeld
*Attorney, Agent, or Firm*—Bruce F. Jacobs

[57] ABSTRACT

A shoe construction which is adjustable in girth to accommodate different foot widths includes a show upper having side edge margins attached to the edges of the shoe sole. The sole is deformable to permit a vertical component of motion of at least one shoe upper side edge margin relative to the foot support surface in the shoe so as to adjust the shoe girth sufficiently to accommodate the width of the foot inserted into the shoe. Various means for achieving such girth adjustment automatically and manually are also disclosed.

33 Claims, 10 Drawing Sheets

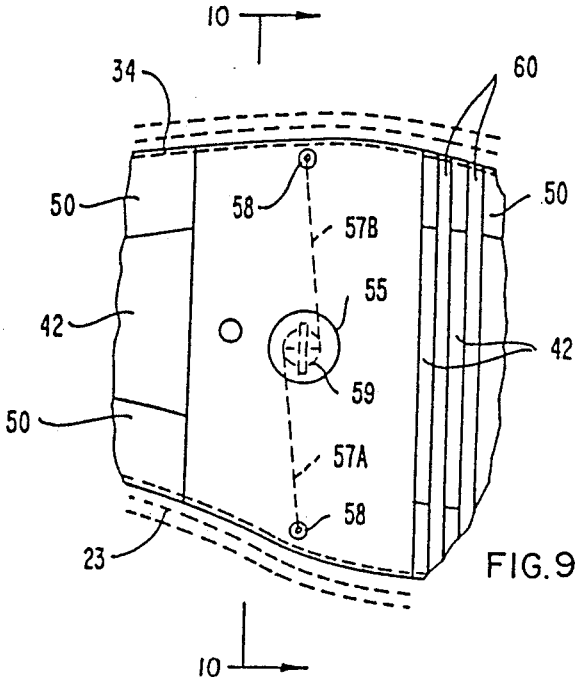
FIG. 9
FIG. 10
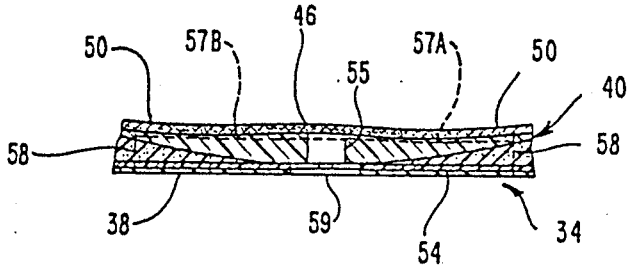

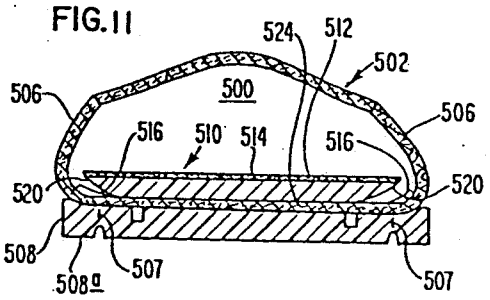
FIG. 11
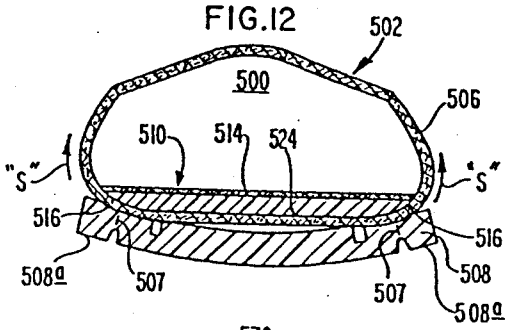
FIG. 12
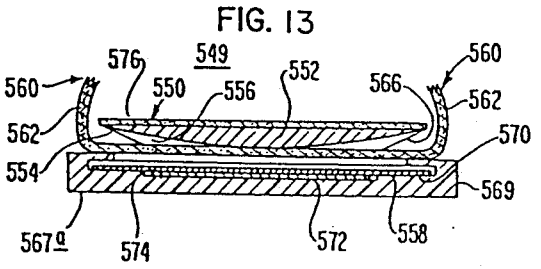
FIG. 13
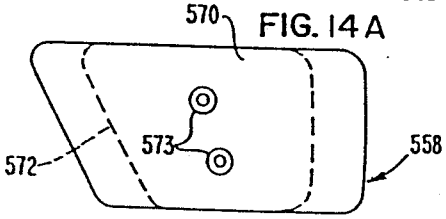
FIG. 14A
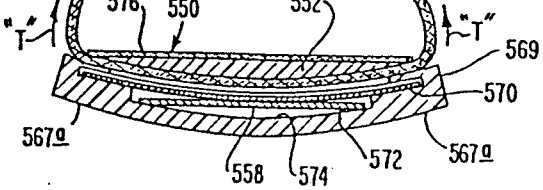
FIG. 14B
FIG. 15

ADJUSTABLE GIRTH SHOES

This invention relates to shoe constructions and more particularly to shoes constructed to be adjustable in girth for better fit.

BACKGROUND OF THE INvENTION

Since the 1700's, shoe inventions have dealt primarily with ways to make shoes, rather than with ways to make them fit, the latter having been considered the proper province of the manufacturer and his suppliers.

We find ourselves more than two centuries later, with excellent machinery making vast quantities of shoes, most of which do not fit nearly as well as they should.

For a shoe to fit properly, it should have a transverse girth which is substantially the same as the girth of the wearer's foot, girth being the transverse circumference around the foot, typically measured at the ball waist and instep of the foot.

However, foot girth dimensions vary over a range of up to two inches for each length size while most popular price shoes now come in only one width per length, to allow marketing of the maximum number of styles with the minimum inventory, for end users who apparently value style and price over the homelier virtues of fit and comfort.

Furthermore, research has shown that a foot usually varies in girth up to two standard widths daily with even greater changes under a variety of physiological conditions causing fluid and/or tissue buildup in the foot.

The prior art has dealt mainly with visible means of girth adjustment such as laces, adjustment straps, and the like, most of which usually do not provide adjustment at the ball of the foot; nor are they useful in the many popular non-adjustable shoe styles, such as boots, slip-ons, loafers, women's pumps, flats, and so forth.

The prior art has also neglected the children's field, where self-adjusting girth would allow a shoe to better fit the growing foot, as well as facilitate the wearing of new slip-on styles that the child would not have to tie or otherwise adjust.

Adjustable girth footwear is not new, as shoes having this capability are disclosed, for example, in my U.S. Pat. Nos. 3,404,468; 3,541,708 and 3,686,777. These prior shoes have non-stretchable uppers with longitudinally extending lower edge margins at least in the foreparts of the shoes turned in toward one another and being free of the direct connection to the sole elements.

In one version, shown in FIGS. 1 to 8 of the first-mentioned patent, at least one of those edge margins in the forepart of the shoe is connected by way of stretchable elastic sheet material extending under the wearer's foot to the middle of the sole element or to the other edge margin; in other shoe versions depicted in FIGS. 9 to 13 of that same patent, those edge margins are connected via the elastic material to the edges of the sole element. All of those shoe constructions provide automatic adjustment of the shoe girth to suit the wearer's foot.

The latter two patents above disclose, in lieu of such elastic sheet material, mechanisms for adjusting the spacing of those shoe upper margins so that girth adjustment can be accomplished manually. While those prior shoe constructions have contributed appreciably to the art, they have certain drawbacks which have tended to inhibit their adoption and use. More particularly, in the described first version of that prior shoe, pebbles, dirt and water tend to infiltrate between the upper and the sole element at each lengthwise segment of the shoe where there is no direct connection between the shoe upper and the sole element. Also, the shoe upper tends to pull away from the sole element along each such segment thereby spoiling the appearance of the shoe. In other versions, the elastic sheet material tends to lose its elasticity due to exposure to sun, ozone and ageing and wear so that the girth adjustment capability of those shoes tends to become degraded over time. Also the elastic material, being a relatively thin sheet of stretch nylon, spandex or the like located right at the sole of the shoe soils easily and is prone to being cut, worn and punctured by contact with curbs, stones and other objects thereby allowing water to penetrate into the shoe. Still further, that exterior stretch material is quite expensive so that shoes of this type would tend not to be economically competitive.

Another technique for adjusting the girth of a shoe essentially by adjusting the elevation of the foot within the shoe is disclosed in U.S. Pat. No. 3,442,031. In this arrangement, a plural-layer auxiliary sole is inserted into the shoe between the insole and sock lining thereby reducing the amount of upper material that extends above the surface that supports the foot. Each of the layers is of such a thickness as to change the girth of the shoe forepart by one standard width. Thus, by removing one layer more upper material is available above that support surface to accommodate a foot one size wider. If a second layer is removed, still more upper material extends above the support surface so that a still wider foot can be accommodated in the shoe. This prior shoe construction is disadvantageous because a person's feet often have different girths or widths. Therefore, adjusting shoe girth in this fashion by elevating the foot within the shoe means that a person's feet may be supported at different heights. This is very undesirable because it has been found that a foot height difference of as little as three sixteenths of an inch is sufficient to cause permanent injury to a person's back and legs. This could tend to provoke heavy product liability litigation which the industry as a whole prefers to avoid.

In sum, in all of my prior adjustable girth shoe constructions, the critical lack of a continuous, firm, non-stretchable, non-elastic edge connection between the shoe upper and the sole element all around the shoe has contributed to the lack of acceptance of such constructions. On the other hand, the solution described in the above-mentioned U.S. Pat. 3,442,031 not only fails to maintain the designed tread of the last and the shoe, but also introduces the orthopedic and related liability problems discussed above.

SUMMARY OF THE INVENTION

This invention aims to provide improved adjustable girth footwear constructions.

Another object is to provide footwear of this general type which has a relatively wide range of girth adjustment.

A further object is to provide an adjustable girth shoe which is devoid of undesirable openings between the shoe upper and the sole element all around the perimeter of the shoe.

A further object is to provide a shoe which is adjustable girthwise yet has a positive non-elastic connection between the shoe upper and the sole element.

Still another object is to provide such a shoe which is comfortable to wear.

Yet another object is to provide footwear of this type with provision for automatic and/or manual girth adjustment.

A further object of the invention is to provide footwear with a girth adjustment capability that adapts to a wide range of shoe styles and categories for both adults and children.

Still another object is to provide adjustable girth footwear which departs to a minimum extent from its conventional non-adjustable counterparts in terms of style and appearance.

Another object is to provide footwear having the above advantages at minimum competitive costs.

Briefly, a shoe made in accordance with my invention has a flexible upper element which is connected non-elastically to a flexible sole element around the perimeter of the shoe so that there are no unwanted gaps or spaces between those elements. When the word "shoe" is used herein, it should be understood to include the different types and styles of footwear commonly worn by adults and children, including flats, loafers, slip-ons, moccasins, pumps, platform shoes, etc.

Means are provided in the shoe for deforming the sole element in the forepart of the shoe relative to the shoe support surface which contacts the underside of the wearer's foot to permit upward movements of at least one side margin of the upper to accommodate the girth of the wearer's foot. In one version of my shoe, the sole element is deformed by deflecting the side edge margins of the sole element upwards relative to that support surface. In another version, the sole element is deformed by expanding the sole element laterally. Both such deformations allow sufficient upward movements of the shoe upper's sides and top elements to achieve a shoe girth variation or adjustment preferably of at least four standard "width" sizes, e.g. from men's size C to men's size EE, the variation being continuous over that range.

The adjustment of shoe girth is accomplished manually and/or automatically in my different shoe constructions. For the former, a mechanism is included in the shoe which can be set by the wearer to allow deformation of the sole element (and the upper elements therewith), by a selected amount as determined by the wearer on a trial and error basis. To achieve automatic girth adjustment, girth adjusting means are included in the shoe which tend to maintain the shoe at the minimum girth of its designed girth range, with both sole and upper conforming to the requirements of that minimum girth. Thus, when the wearer puts on the shoe, the sole element deforms only to the extent needed to allow an increase in upper girth to fit that foot.

While manually adjustable girth will probably be preferred in most athletic or special purpose footwear, automatic girth adjustment means may be the preference in most other cases. In children's shoes, for example, automatic girth adjustment is desirable to prevent inaccurate adjustment of the shoe by the child or mother, and to allow the shoe to "grow" girth-wise naturally along with the often rapidly growing child's foot. Such automatic girth adjustment allows the design of slip-on casuals that give proper support for children too young to be able to tie conventional laced shoes, or even to properly adjust the "Velcro" or similar hook and material eye straps often used now as a lace substitute.

By providing for continuous girth adjustment, my shoe constructions permit a given shoe inventory to fit a maximum number of people, yet such shoes avoid the problems discussed above associated with prior adjustable girth shoes which employ different height shoe inserts or elastic material in the connection between the upper and the sole element. It should be understood, however, that even though my shoes incorporate all these advantages, the shoes can still be made using conventional shoe manufacturing techniques at a cost that is not significantly more than the cost of making a conventional fixed girth shoe of a similar type or style.

BRIEF DESCRIPTION OF THE DRAWINGS

The objects and advantages of the present invention will become more apparent when viewed in conjunction with the following drawings, in which:

FIG. 9 is a plan view of a platform assembly for a shoe similar to the FIG. 1 shoe showing a mechanism for controlling the shoe girth adjustment;

FIG. 10 is a sectional view taken along the line 10—10 of FIG. 9;

FIGS. 11 and 12 are sectional views similar to FIGS. 2 and 3 showing another shoe embodiment whose girth adjusts automatically to the girth of the foot therein;

FIG. 13 is a sectional view similar to FIG. 2 showing still another shoe construction with an automatic girth adjustment capability, with the shoe shown at its minimum girth adjustment;

FIGS. 14A and 14B are plan and side views respectively showing the spring means present in the FIG. 13 shoe;

FIG. 15 is a view similar to FIG. 13 showing that shoe at its maximum girth adjustment;

DESCRIPTION OF THE PREFERRED EMBODIMENTS

Figure 1:
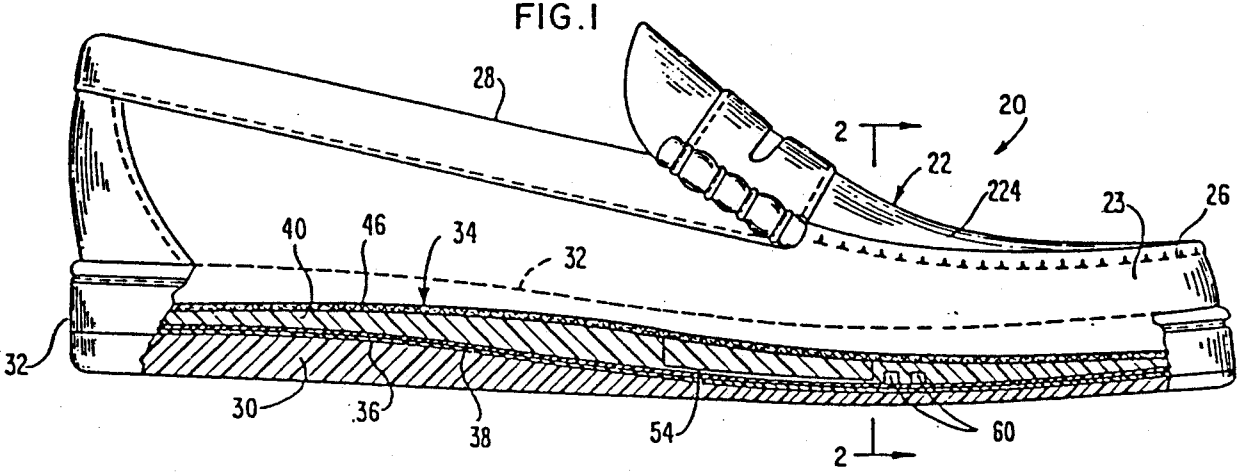
FIG. 1 is a side elevational view with parts broken away of a shoe constructed according to the present invention.
Figure 2:
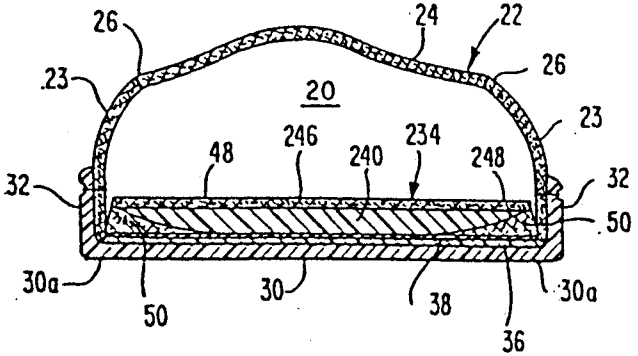
FIG. 2 is a sectional view taken along lines 2—2 of FIG. 1 showing the shoe at its minimum girth adjustment.

Refer now to FIGS. 1 and 2 of the drawings which show an item of footwear commonly known as a moccasin or "loafer" type of shoe 20 generally similar to the ones in my application filed concurrently herewith entitled "Adjustable Shoe Girth Constructions", which disclosure is incorporated herein by reference. This shoe includes a flexible upper 22 having a vamp 23 and a plug 24 which are typically joined by stitching to form a seam 26 around the forepart of the shoe 20, with a cuff 28 being provided around the top edge of the back part of the shoe upper. Shoe 20 also has a sock lining 36 stitched to the lowermost marginal edges of upper 22. The upper is, in turn, stitched or otherwise secured to a flexible sole element 30. In the illustrated shoe embodiment, the upper is stitched to the upstanding walls 32 of a cup-molded sole element or unit sole at the uppermost edges thereof.

Positioned in shoe 20 above the sock lining 36 is a footbed assembly 34. This assembly includes a relatively stiff footbed or insert 40 consisting of a relatively thick slab of high density polypropylene or like material. Affixed to the underside of footbed 40 is a sheet or layer 38 of a thin tough flexible material such as high density polyethylene. Also, a conforming innersole 46 may be disposed on the upper surface of footbed 40, that innersole extending the full width of the shoe and from the toe to the heel thereof. The upper surface of the footbed assembly 34 may be contoured orthopedically as shown to be somewhat higher on the inside heel breast and arch area as compared with the corresponding outside area and it has a somewhat concave curvature in the heel portion thereof to comfortably accommodate and center the heel of the wearer's foot. It may also have contours forward of the heel area to better support and position the foot in the shoe in that area.

Figure 4:
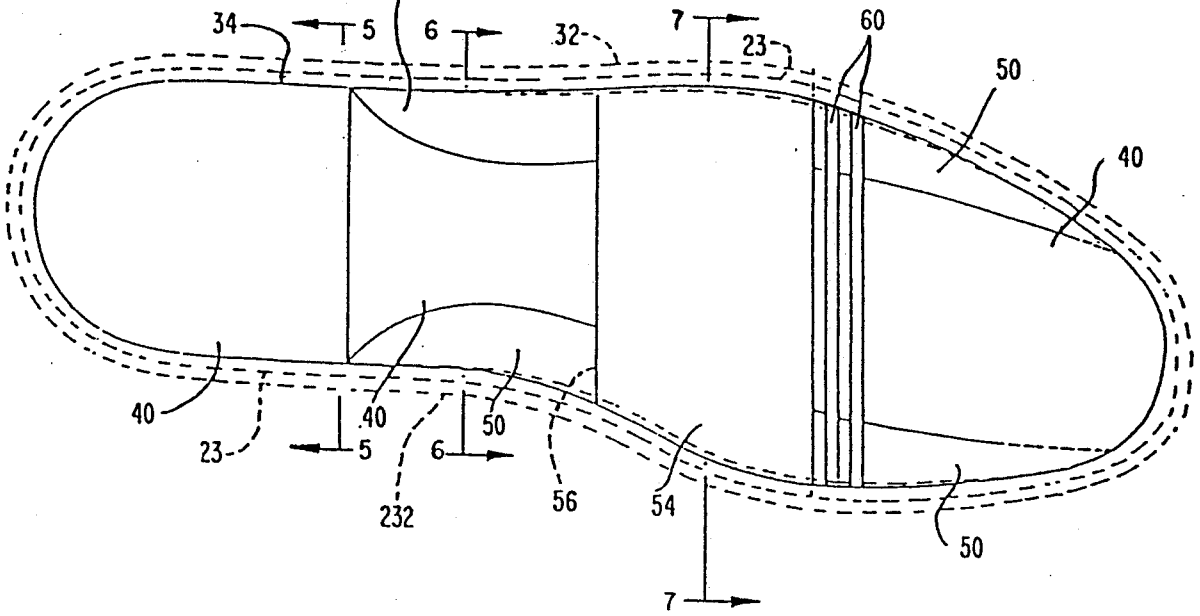
FIG. 4 is a bottom view of the footbed or insert in the FIG. 1 shoe.
Figure 5:
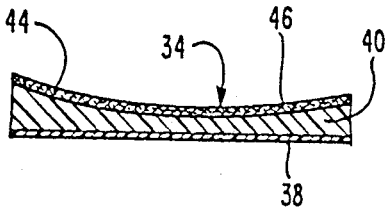
FIG. 5 is a view of the footbed assembly taken along lines 5—5 of FIG. 4.
Figure 6:
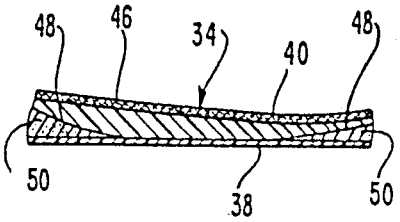
FIG. 6 is a view of the footbed assembly taken along lines 6—6 of FIG. 4.
Figure 7:
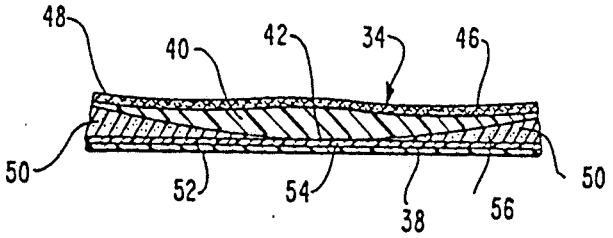
FIG. 7 is a view of the footbed assembly taken along lines 7—7 of FIG. 4.

As best seen in FIGS. 2 and 4–7, the underside of footbed 40 or insert is contoured at one and preferably both bottom side edge margins 48 thereof to allow limited controlled vertical deformation of the side edge margins 30*a* of the sole element 30 in the critical fitting area toeward of the heel breastline, i.e. the line defined by the usual position of the forward face of a usual heel element. More particularly, whereas the underside of footbed 40 is flat in the heel area of the bed as shown in FIG. 5, it has a chamfer on at least one and preferably both sides thereof each of which extends longitudinally from the heel breast forward towards the toe portion of the footbed as best seen in FIG. 4. The footbed also has a more extensive arcuate bottom chamber between ball and instep, to accommodate a spring to be described. Furthermore, the contours or profiles of those chamfers may be different from one another and they both vary along the length of the footbed 40 as shown in FIGS. 5–7 leaving gaps of varying widths between the footbed edge margins 48 and the sheet or layer 38 at the underside of bed 40. Preferably those gaps are filled with compressible resilient foam material 50 to exclude foreign material from those spaces as well as to help urge the shoe continually to its minimum girth adjustment.

In order to increase the flexibility of footbed assembly 34, a series of transverse grooves 60 may be included in the underside of footbed 40 in the ball area thereof. These grooves facilitate bending of assembly 34 and thus shoe 20 as a whole when the wearer of the shoe is walking. If desired, these grooves may also be filled with compressible resilient foam material to exclude dirt therefrom.

Figure 3:
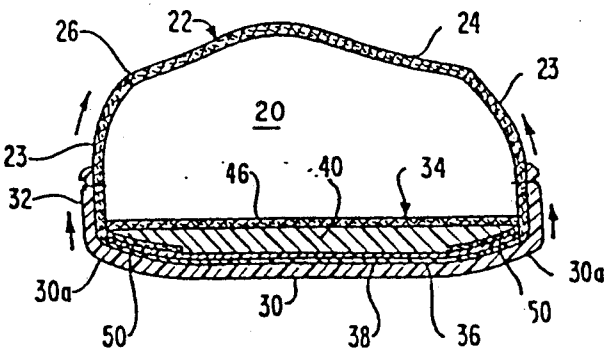
FIG. 3 is a view similar to that of FIG. 2 showing the shoe at its maximum girth adjustment.

In use, footbed assembly 34 is positioned in shoe 20 as shown in FIGS. 1 and 2. Preferably, that assembly is not attached physically either to the shoe upper 22 including sock lining 36 or to the sole element 30. Sole element 30, or at least the edge margins 30*a* thereof underlying the contoured edge margins 48 of footbed 40, are flexible and upwardly deformable allowing an upward flexing of the sole element edge margins 30*a* toward footbed edge margins 48 from a minimum girth condition shown in FIG. 2 wherein sole element 30 is flat, to a condition depicted in FIG. 3 wherein the edge margins of sole element 30 are deformed or deflected upwards to a maximum girth condition. It should be understood that these vertical movements of the edge margins 30*a* are greater than the slight upward curling that sometimes occurs at the edge margins of an ordinary shoe sole due to normal flexing of the shoe when worn. This deformation of sole element 30 results in an upward component of motion of the side margins of vamp 23 and sole sidewalls 32, relative to the surface of the innersole 46 which contacts the underside of the wearer's foot. These movements, shown by the arrows in FIG. 3, are appreciable and can increase the girth of the shoe by as much as four standard shoe width sizes, as from women's size AAA to B or from men's size C to EE.

Figure 8:
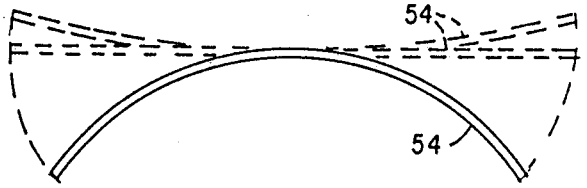
FIG. 8 is a side elevational view of spring means utilized in the FIG. 1 shoe.

Means are provided in shoe 20 for automatically urging or biasing sole element 30 to its flatter FIG. 2 condition which gives shoe 20 its minimum girth. In the illustrated shoe 20, the preferred biasing means include a generally trapezoidal leaf spring 54 best seen in FIG. 8. This spring is incorporated into the footbed assembly 34 between footbed 40 and the lower layer 38 in the ball area of that assembly as shown in FIGS. 1, 4 and 7. More specifically, the spring fits into transverse channels 56 (FIGS. 1 and 7) disposed in the underside of footbed 40. The spring is formed so that in its natural unstressed state, it has the shape of an arch as shown in solid lines in FIG. 8. When spring 54 is incorporated into the footbed assembly 34, it is sandwiched between footbed 40 and sheet 38 and flattened to some extent as shown in FIG. 7. Thus when assembly 34 is held down in the shoe by a wearer's foot, the spring exerts a slight downward bias on side edges of layer 38 and the underlying edge margins 30*a* of sole element 30 thereby tending to maintain the sole element in its undeformed flat condition shown in FIG. 2 wherein shoe 20 has a minimum girth. Additional adjustment means could include those resulting from the tendency of the resilient material in the footbed's edge margins to return to a less compressed state.

If a foot having the same girth as the minimum girth of shoe 20 is inserted into the shoe, there should be little or no deformation of sole element 30 so that the shoe will remain as depicted in FIG. 2. However, when a so-called "wider" foot with its greater girth is inserted into the shoe, the edge margins 30*a* of sole element 30 will be flexed upwardly in opposition to the bias of spring 54 so that sufficient upward displacement of the side margins of vamp 23 relative to innersole 46 will occur to accommodate the larger width and girth of that foot, adjusting within the designed girth range of the shoe to perfectly fit the foot therein, providing the foot's girth lies within said range.

Instead of providing for fully automatic girth adjustment in shoe 20, a mechanism may be incorporated into the footbed assembly for controlling that adjustment manually as depicted in FIGS. 9 and 10. In this shoe construction, a drum 55 is rotatably mounted in footbed or insert 40 and spring 54 at the center of those parts. The lower end of drum 55 is accessible and carries a slot 59 which permits the drum to be rotated manually by a screwdriver or the like through the bottom of the footbed assembly 34. A pair of cables 57A and 57B have corresponding first ends wound in opposite directions around the drum. The opposite end segments of the cables pass through grommets 58 mounted in footbed 40 adjacent to the side edges thereof. Those cable segments thence extend down through holes in the ends of spring 54 and are secured to the flexible layer 38 at the underside of spring 54. In this arrangement, when drum 55 is turned in the clockwise direction as viewed in FIG. 9, cables 57A and 57B are wound up on the drum. This tensions the cables so that they draw the opposite ends of spring 54 toward the profiled edge margins 48 of footbed 40. Thus the setting of drum 55 controls the extent to which spring 54 can return toward its flat condition shown in FIG. 8 and thus the extent to which the spring can bias or urge sole element 30 to its undeformed condition depicted in FIG. 2. In other words, the drum position sets a lower limit for automatic girth adjustment. Also, of course, conventional detent means (not shown) may be provided to maintain the drum at its various adjustment settings.

Thus, for example, with reference to FIG. 10, if the drum 55 is adjusted as shown in FIG. 10 and that footbed assembly is inserted in shoe 20 (FIG. 1), the shoe will have a minimum girth more or less as depicted in FIG. 2 and will provide fully automatic girth adjustment as described above. On the other hand, if drum 55 is adjusted to draw the ends of spring 54 tightly against the edge margins 48 of footbed 40, such adjustment will result in the shoe having maximum girth as depicted in FIG. 3, but no automatic adjustment capability. If now the drum 55 is set at an intermediate position, spring 54 will be permitted to relax to a limited degree so that the shoe will fit a foot of a particular intermediate girth, including a somewhat loose fit if so desired, and will adjust automatically to feet of larger girth up to the maximum girth of the designed girth range of the shoe.

Figure 22:
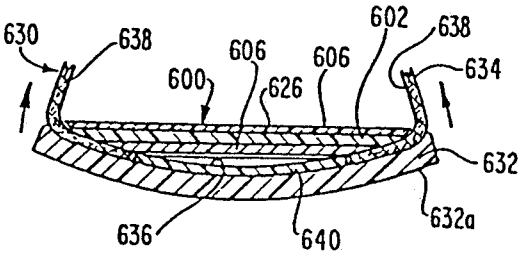
FIGS. 21 and 22 are sectional views taken along the line 21—21 of FIG. 19, showing that shoe at its minimum and maximum girth adjustments, respectively.

FIGS. 11 and 22 illustrate a shoe 500 whose girth can be set manually by positively controlling the spacing between the edge margins of the footbed and the edge margins of the sole element. This shoe includes an upper shown generally at 502 with a vamp 506 having a continuous portion 524 extending under the foot and attached by stitching 507 or the like to a flexible resilient sole element 508.

Located inside the shoe is a footbed assembly 510 composed of a footbed 512 which may be provided with a sock lining 514 at its upper surface. The footbed 512 is similar to footbed 40 described above in that it extends the entire length of the shoe and has undersurface edge margins 516 which may be similar to the margins 48 in the FIG. 1 shoe, although without the spring-accommodating transverse channels 56 therein. Positioned between the edge margins 516 at each side of the shoe and the underlying margins of the vamp 506, is one or more shim strips 520, the shim strips, if more than one, being arranged in a stack. Each shim strip 520 is coextensive with the edge margin of footbed 512 and it is generally tapered or wedge-shaped in cross section, as best seen in FIG. 11. The edge margins 516 are preferably also contoured along their lengths.

When the spaces under the footbed edge margins 516 are filled with one or more shim strips 520, sole element 508 is maintained in a substantially flat undeformed condition as shown in FIG. 11, with the shoe adjusted thereby for minimum girth or shoe width size.

To increase the girth of the shoe to accommodate a wider foot, one or more of the shim strips 520 is removed from at least one and preferably both sides of the shoe thereby providing clearance between the footbed edge margins 516 and the underlying vamp margins. Accordingly, the edge margins **508*a* of the sole element are permitted to deform or deflect upwardly toward the footbed margins 516. This allows concomitant upward movements of the lower side margins of the vamp 506 relative to innersole 514 on which the foot is supported as shown by arrows S in FIG. 12 thereby increasing the girth of the shoe to accommodate that larger width foot. The sole element 508**, being resilient, can exert a gentle downward pull on the vamp to assure that the shoe fits snugly on the foot.

If desired, the shim strips 520 may be adhered to the underside of the footbed 512 in which case they may be stripped away when it is necessary to increase the size of the shoe. Also, the number of strips present at each side of the shoe or in the two shoes of a pair at any given time may be the same or different depending upon the needs and desires of the particular wearer. Since the foot is always primarily supported by the platform assembly, the number of strips in the shoe has no effect on the elevation of the foot within the shoe or above the ground. It is also quite feasible to form shim strips of varying wedge angles and profiles as the edge margins of separate insole members arranged to be positioned under the footbed assembly 510. In both cases, the shim strips positively control the upward deformation or displacement of the edge margins of the sole element and thus the upward movements of the vamp side margins to accommodate the shoe to the particular wearer's foot girth.

FIGS. 13 to 15 illustrate a shoe construction 549 somewhat similar to the one just described and which provides for automatic rather than manual adjustment of the shoe girth. This shoe has an upper 560 whose vamp 562 also extends under the wearer's foot and is attached directly to a flexible sole element 569 by stitching, cement or other suitable means. A footbed assembly shown generally at 550 is positioned inside the shoe. Like assembly 510, it includes a relatively stiff footbed 552 and a thin sock lining 576 covering the upper surface of that member. Also, the underside of footbed 552 has edge margins 554 which are contoured in more or less the same manner as the similar footbed described above in connection with the FIGS. 1 and 11 shoes.

In this shoe, however, the means for adjusting the shoe girth is not incorporated into the footbed assembly 550. Rather, it is present in the sole element 569. More particularly, a transverse pocket or recess 574 is formed in the sole element 569 in the ball area of that element. Positioned in recess 574 is a spring assembly 558. As best seen in FIGS. 14A and 14B, spring assembly 558 comprises a relatively long thin highly flexible generally trapezoidal spring member 570 and a shorter thicker stiffer similarly shaped spring member 572. Spring member 570 in its unstressed state is bowed or arched as shown in phantom in FIG. 14B, while spring member 572 is normally flat. When spring member 572 is positioned under spring member 570 and the two springs are secured together by rivets 573 as shown, the spring member 570 is forced by the its stiffer mate to assume a more or less straight flat configuration as shown in solid lines in FIG. 14B. Thus, that spring member 570 is pre-loaded and designed to have a favorable spring rate, e.g. of about 0.6 lb. per longitudinal inch of spring dimension, when its ends are deflected upward only slightly from their flat solid line positions, e.g. to the upper position shown in phantom in FIG. 14B. A spring so "preloaded" will therefore have a spring rate such that the spring and with it, the sole and the upper elements exert comfortable gentle pressure on those feet within its design girth range.

When the spring assembly 558 is positioned in recess 574 inside sole element 569, both the spring assembly and the sole element remain essentially flat so that there is appreciable clearance between the contoured edge margins 554 of footbed 552 and the underlying vamp margins on sole margins 569*a*. Thus, the shoe depicted in FIG. 13 reposes in a condition of minimum girth so that it may fit, for example, a men's size C foot width. When a wider foot is inserted into the shoe, say a men's size EE, the sole edge margins 569*a* are free to flex upwards relative to the edge margins 554 of footbed 552 and in opposition to the urging of spring member 570. This permits an upward displacement of the lower side margins of vamp 562 in the direction of arrows T in FIG. 15 by just the right amount to accommodate the increased girth of that larger foot, all as described above in connection with the FIGS. 1 and 11 shoes.

Figure 16:
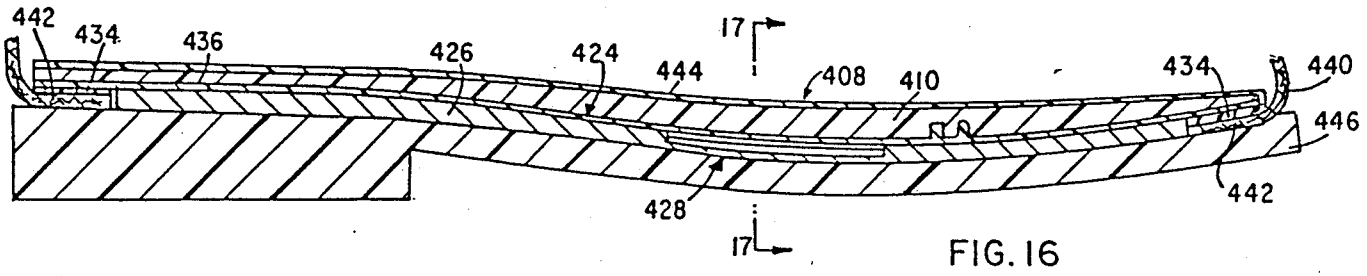
FIG. 16 is a longitudinal sectional view of still another shoe construction with provision for automatic girth adjustment.
Figure 17:
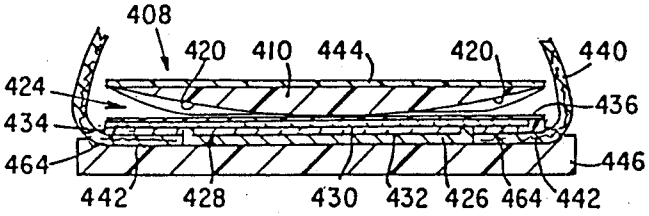
FIGS. 17 and 18 are sectional views taken along lines 17—17 of FIG. 16 showing the shoe at its minimum and maximum girth adjustments respectively.
Figure 18:
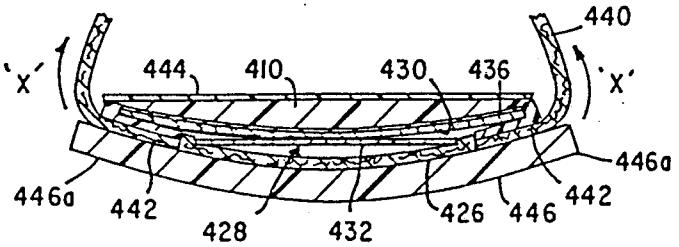

FIGS. 16 to 18 illustrate a shoe construction wherein a spring assembly similar to assembly 558 is incorporated into a shoe insole rather than outsole element. In this shoe, the shoe vamp 440 has in-turned lower edge margins 442 to which is stitched, cemented or otherwise secured a flexible deformable sole element 446. Positioned inside the shoe is an insole assembly shown generally at 424 and positioned on that assembly is a footbed assembly 408 which is more or less the same as and performs the same function as the footbed assembly 550 depicted in FIG. 13, in that it includes a footbed 410 having contoured underside edge margins 420 and a sock lining 444 covering that member.

Insole assembly 424 comprises a filler 426 which fits between the edges of the vamp margins 442. Above the filler 426 is a spring assembly 428 which is substantially the same as the assembly 558. Thus, that assembly includes a relatively short stiff flat spring member 432 which seats in a shallow pocket in the filler 426 and a longer thinner more flexible spring member 430 which is riveted to member 432. The opposite ends of spring member 430 overlie the vamp edge margins 442 and as best seen in FIG. 17, those ends are connected by rivets or pins 464 to the sides of a skeleton marginal insole member 434. This member 434 is an annular member which extends all around the perimeter of the shoe on top of the inturned edge margins 442 of the vamp and it is secured to the vamp margins by cement or other suitable means.

Preferably, the upper surface of spring member 430 is covered over by a sock lining 436 to give the interior of the shoe a finished appearance. The insole assembly 424 can be incorporated into the shoe at the time of its manufacture by inserting the filler 426 after lasting the vamp margins 442 in the normal manner, or, if preferred, the assembly could be removable, as is often the case. This shoe functions in more or less the same way as the FIG. 13 shoe to automatically adjust the shoe girth to accommodate the girth of the wearer's foot.

FIG. 17 illustrates the shoe in its minimum girth condition wherein the sole element 446 is undeformed and lies flat on the walking surface. When a foot having a larger girth is inserted into the shoe, the edge margins 446*a* of the sole element 446 are able to deform or flex upwardly as shown in FIG. 18 permitting upward movements in the direction of the arrows X of the lower side margins of the vamp 440 relative to the top surface of footbed assembly 408 on which the foot is supported. These movements continually act to adjust the girth of the shoe by just the right amount to accommodate the girth of the wearer's foot.

FIGS. 19 to 22 illustrate another mechanism for adjusting shoe girth manually. Here again, the shoe comprises an upper shown generally at 630 including a vamp 634 having in-turned lower edge margins cemented, stitched or otherwise secured to an outsole element 632. A footbed assembly shown generally at 600 is positioned in the shoe. This assembly comprises a footbed 602 having contoured side margins 604 on the underside thereof, as described above for the other similar footbeds.

A pair of transversely movable, relatively rigid struts 606 are positioned in a recess 607 in the underside of member 602. These are pivotably connected to that member by a pair of heel pivot pins 608 and a pair of toe pivot pins 610 so that the struts extend along the forepart of footbed 602. Each strut 606 has a transverse cut 612 midway along its length, terminating in a "living" hinge 614 adjacent to its inner edge as shown in FIG. 19 which permits the struts 606 to bend or flex laterally outward as indicated by the arrows "O" in that figure.

Figure 19:
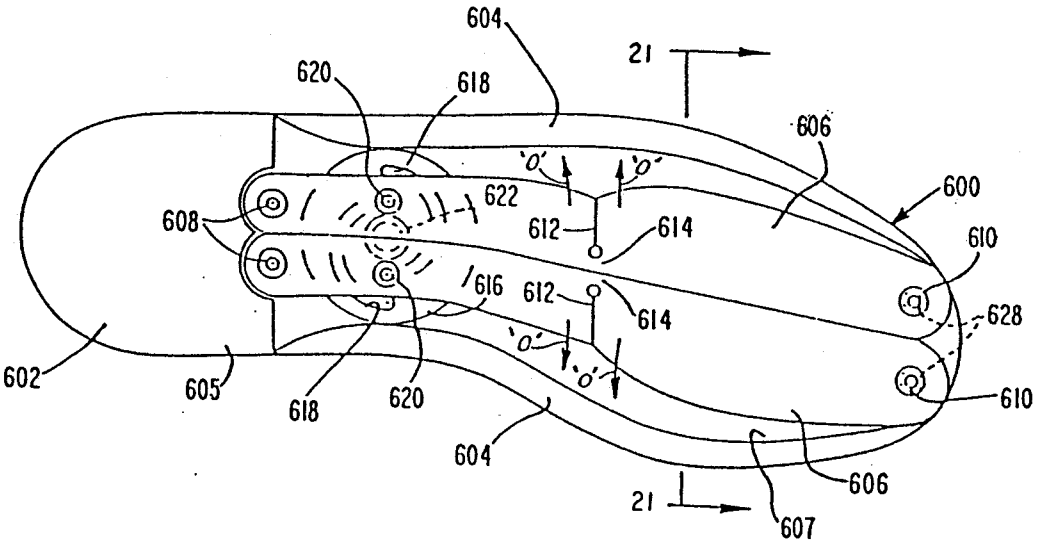
FIG. 19 is a bottom view of a footbed assembly for a further embodiment of a girth-adjustable shoe.
Figure 20:
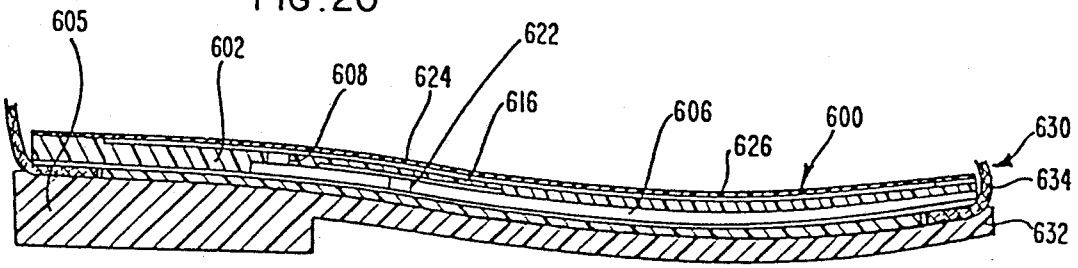
FIG. 20 is a longitudinal sectional view of a shoe construction utilizing the footbed assembly of FIG. 19.

A rotatable cam plate 616, having a pair of spiral cam slots 618 cut therein, is positioned in a clearance space in the underside of the footbed 602 above struts 606 in the waist area of the shoe as best seen in FIGS. 19 and 20. Also, cam follower pins 620 mounted to struts 606 are in following engagement with the two cam slot 618 in the cam plate 616. The cam plate 616 is secured to a post 622 rotatively mounted to the footbed 602. As shown in FIG. 20, a slot 624 formed in the upper end of post 622 is accessible through an aperture in sock lining 626 on footbed 602 in order to rotate the cam plate 616.

The toe pivot pins 610 extend through slightly elongated openings 628 in the toe end of each of the struts 606. After the footbed assembly 600 is placed in a shoe, as shown in FIGS. 20 and 21, these elongated openings 628 allow longitudinal movements of the forward ends of the struts 606 with respect to the platform 602 as would occur during the walking cycle.

The footbed 602 of assembly 600 is wrapped about its bottom and side edges by a thin flexible sheet 636 of polypropylene or like material, which may be lasted over the marginal upper surface of the footbed 602 as shown. The sock lining 626 is then positioned on member 602 with an opening in the insole 626 in alignment with the upper end of the post 622.

Rotation of the post 622 by a coin or screwdriver inserted in the slot 624 therein, effectuates rotation of the cam plate 616. Such rotation causes the follower pins 620 follow the lateral courses of the cam slots 618 and depending upon the direction of rotation, causes the struts to either spread apart laterally at their hinge points 614 or come together, as their end portions rotate around their pin fastenings to the base. In FIGS. 19 and 22, the struts 606 are shown close together at the centerline of the footbed assembly. In this position, the edge margins 632*a* of the sole element 632 are able to flex or deform upwards towards the contoured edge margins 604 of footbed 602. This allows upward movements of the side margins of the vamp relative to the surface of the footbed assembly which contacts and supports the foot inside the shoe as shown by the arrows in FIG. 22. This position of the struts 606 may allow the shoe to accommodate say, a men's "EE" foot width.

Figure 21:
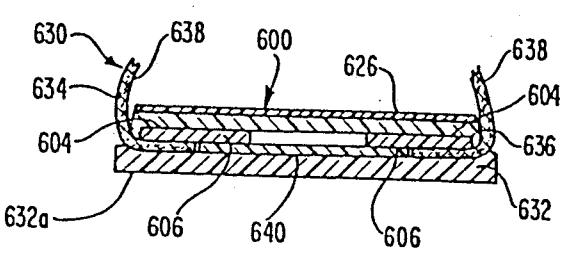

When the cam plate 616 is rotated in the opposite direction so that the struts 606 are spread apart, as shown in FIG. 21, the struts 606 provide a stiff shield against any appreciable upward flexing of the sole element edge margins 632*a* so that minimal or no upward movements of the shoe upper side margins occur. This minimum girth setting of the cam plate may accommodate the shoe to a foot of, say, men's size C width with intermediate settings of the cam plate 616 achieving infinitely variable shoe girth values within the designed girth range limits of the shoe, which, in this case, are men's C and EE.

Figure 23:
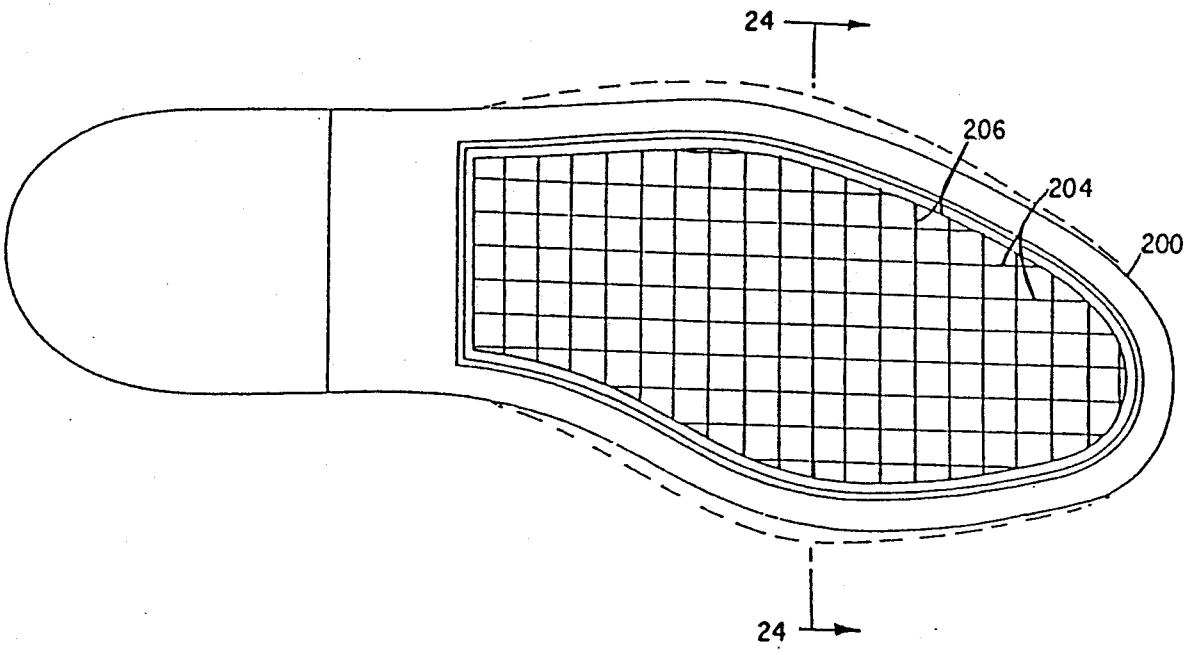
FIG. 23 is a bottom view of the sole element in a further embodiment of my invention.
Figure 24:
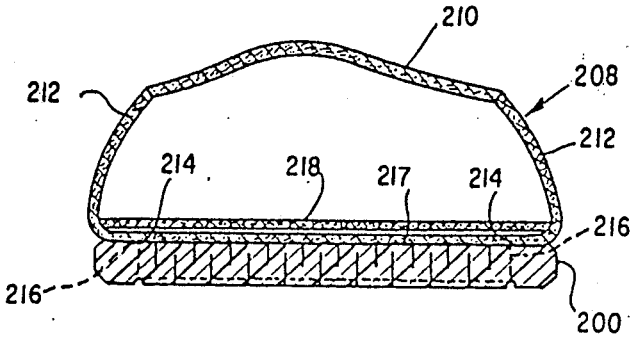
FIGS. 24 and 25 are sectional views taken along lines 24—24 of FIG. 23 showing this shoe construction at its minimum and maximum girth adjustments, respectively.
Figure 25:
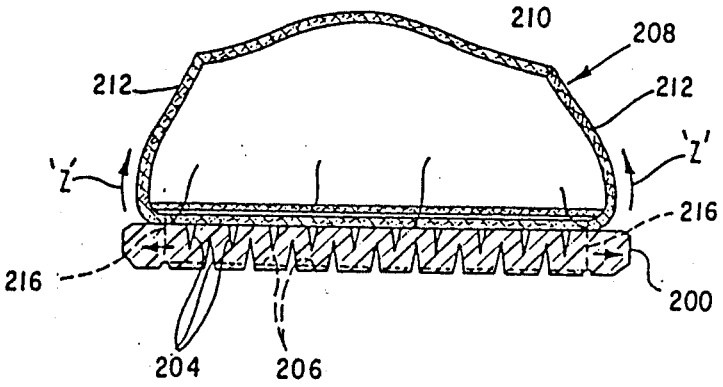

FIGS. 23 to 25 illustrate still another shoe construction that provides automatic girth adjustment by deforming the shoe sole element. Here, however, the sole element is simply expanded laterally or transversely preferably at least one-eighth inch and, usually up to as much as three-eighths inch depending on the amount of girth adjustment required. This shoe, like the others, includes an upper 208 having a vamp 212 with in-turned lower edge margins 214 secured by stitching 216 or the like to the side edge margins of a sole element 200. The securement of the vamp to the sole element at 216 would preferably be set in approximately one centimeter from the corresponding side edge of the sole element 200. Attached to the opposite edges of vamp margins 214 is a filler sheet 217 of laterally deformable material. Preferably also a floating insole 218 is provided inside the shoe.

Referring to FIGS. 23 and 24, prior to attaching sole element 200 to the shoe upper, the top and bottom faces of the sole element are slitted or micro-siped to provide a series of longitudinal slits 204 extending partially through the sole element, with the slits in the two faces being staggered as shown. As seen in FIG. 23, these slits 204 are confined to the forepart of the shoe sole element 200. The bottom face of the sole element 200 may also be provided with a series of shallow transverse grooves 206. These transverse grooves do not contribute to the invention and may be included simply for traction or aesthetic reasons.

Sole element 200, by virtue of slits 204, is elastically deformable or expansible laterally between a minimum width condition shown in FIG. 24 to a maximum width condition illustrated in FIG. 25. This expanding deformation of the sole element outward produces a concomitant upward motion of the side margins of the vamp 212 as shown by the arrows Z in FIG. 25. These upward movements of the vamp relative to the insole 218 that contacts the underside of the foot increase the girth of that shoe so that the shoe can accept a foot of corresponding increased girth, all as described above in connection with the other shoe embodiments. The natural resilience of the stretched sole element 200 tends to urge the sides of the upper inwardly and downwardly thus assuring a snug fit on the wearer's foot.

Other laterally extensible sole constructions can be envisioned, such as one consisting of a molded rubber matrix or wavy pattern filled with foam rubber, which will extend at least one-eighth inch to allow the requisite girth adjustment. It should also be understood that the sole can be formed initially with open V-shaped slits or grooves as in FIG. 25 in which case the sole would be compressible laterally one-eighth inch or more to the condition shown in FIG. 24. This compression would allow downward movements of the side margins of vamp 212 to achieve girth adjustment in the opposite sense. In this case, the specific shoe girth would be adjusted manually, say, by a drum and cable mechanism similar to the one in FIG. 9 that controls the spacing of the edge margins of the sole element.

It will be appreciated from the foregoing that all of the shoe constructions incorporating my invention permit manual and/or automatic adjustment of shoe girth to allow a single shoe to accept a relatively wide range of foot widths. Yet, in all cases, there is a positive nonelastic securement between the shoe upper and the sole element so that there are no gaps between those shoe components that could spoil the appearance of the shoe or provide an avenue for the infiltration of dirt and water. Moreover, all of the above shoe constructions can be fabricated using standard shoe manufacturing techniques so that the invention can be incorporated into the shoes without increasing costs appreciably above the costs of conventional shoes of equivalent types and styles.

It will thus be seen that the objects set forth above among those made apparent from the preceding description are efficiently attained. Also, certain changes may be made in the above constructions without departing from the scope of the invention. For example, the footbed assembly and sole element may be a unitary part having longitudinal grooves in its opposite side edges at least in the ball area of the shoe. The portion of that part above the grooves, being relatively thick, is somewhat rigid and functions as the footbed. The edge margins of that part below the grooves, being thinner, are flexible and resilient. When the lower edge margins of the shoe upper are connected to those lower edge margins below the grooves, the shoe will adjust automatically to the girth of the foot just as described above. Therefore, it is intended that all matter contained in the above description and shown in the accompanying drawings shall be interpreted as illustrative rather than limiting.

It is also to be understood that the following claims are intended to cover all of the generic and specific features of the invention herein described.

What is claimed as new and desired to be secured by Letters Patent of the United States is:

I claim:

1. A shoe capable of accommodating different foot widths, said shoe comprising a shoe upper having vertically movable side portions;

a sole element having a heel portion, a toe portion and a midportion between said heel and toe portion;

means for attaching said upper side portions to opposite sides of said sole element midportion;

a foot support surface disposed inside the shoe in a position to contact the underside of a foot inserted into the shoe, said sole element being deformable at least at about its midportion and cooperating with at least one upper side portion to permit vertical movement of at least one of said upper side portions relative to said foot support surface so as to permit the adjustment of the girth of the shoe to accommodate the girth of a foot supported on said surface; and a means for permitting deformation of the sole element without causing any substantial change of the contour of the foot support surface or movement thereof.

2. The shoe defined in claim 1 wherein each said sole element midportion has at least one side edge margin that deforms by flexing vertically with respect to said foot support surface.

3. The shoe defined in claim 2 and further including means for urging at least one sole element side edge margin with respect to said foot support surface.

4. The shoe defined in claim 3 wherein said urging means include resilient material in said sole element.

5. The shoe defined in claim 3 wherein said urging means comprise spring means positioned in said sole element at least at the midportion thereof.

6. The shoe defined in claim 3 wherein said urging means comprise resilient means positioned in said shoe over said sole element midportion.

7. The shoe defined in claim 3 wherein said urging means urge movement of both of said sole element side edge margins and comprise an elongated leaf spring positioned in said shoe below said foot support surface so that the opposite ends of said spring overlie and are urged toward the side edge margins of the sole element.

8. The shoe defined in claim 7 wherein said leaf spring is arched in its natural unstressed state.

9. The shoe defined in claim 8 and further including a relatively stiff flat member mounted with said leaf spring so as to minimize the arch therein thereby to preload said leaf spring.

10. The shoe defined in claim 7 and further including means in said shoe for allowing only limited vertical flexing movement of said at least one sole element side edge margin.

11. The shoe defined in claim 2 wherein the girth adjustment is at least 3/16 inch.

12. The shoe defined in claim 2 and further including means in said shoe for allowing only limited vertical flexing movements of said sole element side edge margins.

13. The shoe defined in claim 12 wherein said allowing means include footbed means positioned in said shoe above said sole element, the undersurface of said footbed means having flex-resistant side edge margins which overlie said side edge margins of said sole element at least at the midportion thereof.

14. The shoe defined in claim 13 wherein said side edge margins of the footbed means are contoured along their lengths so that the sole element side edge margins can deform to different degrees along their lengths as the shoe's girth is adjusted.

15. The shoe defined in claim 13 wherein said limiting means also include at least one changeable shim means positioned under said footbed means side edge margins, the total displacement of said shim means determining the extent of flexing of said sole element side edge margins.

16. The shoe defined in claim 12 wherein said allowing means also include a pair of flat relatively rigid longitudinal strut arrangements swingably mounted to said footbed means for movement laterally in said shoe below said side edge margins of the footbed means for limiting the upward flexing of said sole element side edge margins, and means for adjusting said strut arrangements.

17. The shoe defined in claim 13 and further including means for urging said sole element side edge margins away from said footbed means side edge margins.

18. The shoe defined in claim 17 wherein said urging means include resilient material in said sole element.

19. The shoe defined in claim 17 wherein said urging means include spring means positioned in said sole element.

20. The shoe defined in claim 17 wherein said urging means comprise a spring assembly including a normally arched leaf spring and a stiff flat member mounted with the leaf spring so as to substantially flatten said spring to a pre-loaded condition.

21. The shoe defined in claim 17 wherein said urging means comprise a leaf spring arranged with said footbed means below said side edge margins thereof so that the opposite ends of said leaf spring overlie the side edge margins of said sole element.

22. The shoe defined in claim 21 and further including control means for manually adjusting the flexing of said leaf spring ends for girth adjustment of said shoe.

23. The shoe defined in claim 22 wherein said control means include means for adjusting the range over which said leaf spring ends can flex to achieve girth adjustment of said shoe.

24. The shoe defined in claim 23 wherein said adjusting means include winding means rotatably mounted to said footbed means and a pair of cables having corresponding first ends mounted to opposite ends of said leaf spring and corresponding second ends wound in opposite directions about said winding means so that the rotational adjustment of said winding means determines the extent to which the leaf spring can return to its said preloaded condition.

25. The shoe defined in claim 1 wherein said attaching means are adjacent to the side edges of the sole element and said sole element midportion deforms laterally.

26. The shoe defined in claim 25 wherein said sole element is made of a resilient material and includes a series of spaced-apart longitudinal slits or grooves extending along its said midportion that allow said sole element to deform laterally.

27. A shoe capable of accommodating different foot widths, said shoe comprising a shoe upper having vertically movable side portions;

a sole element having a heel portion, a toe portion and a midportion between said heel and toe portions;

means for attaching said upper side portions to opposite sides of said sole element midportion;

a foot support surface disposed inside the shoe in a position to contact the underside of a foot inserted into the shoe, said sole element being deformable laterally at least at about its midportion and cooperating with at least one upper side portion to permit vertical movements of said upper side portions relative to said foot support surface so as to permit adjustment of the girth of the shoe to accommodate the girth of a foot supported on said surface; and a means for permitting deformation of the sole element without causing any substantial change of the contour of the foot support surface or movement thereof.

28. The shoe defined in claim 27 wherein said sole element can deform at least one-eighth inch at its midportion.

29. The shoe defined in claim 27 wherein said sole element can deform at least three-sixteenth inch at its midportion.

30. The shoe defined in claim 27 wherein said sole element can deform at least one-quarter inch at its midportion.

31. The shoe defined in claim 27 wherein said sole element can deform at least three-eighths inch at its midportion.

32. The shoe defined in claim 1, wherein the means for permitting deformation comprises a footbed assembly containing the foot support surface.

33. The shoe defined in claim 27, wherein the means for permitting deformation comprises a footbed assembly containing the foot supper surface.

* * * * *